US009953571B2

(12) United States Patent
Hu

(10) Patent No.: US 9,953,571 B2
(45) Date of Patent: Apr. 24, 2018

(54) PIXEL DRIVING CIRCUIT, A PIXEL DRIVING METHOD FOR THE SAME, AND A DISPLAY APPARATUS

(71) Applicants: BOE Technology Group Co., Ltd., Beijing (CN); Hefei Xinsheng Optoelectronics Technology Co., Ltd., Anhui (CN)

(72) Inventor: Zuquan Hu, Beijing (CN)

(73) Assignees: BOE TECHNOLOGY GROUP CO., LTD., Beijing (CN); HEFEI XINSHENG OPTOELECTRONICS TECHNOLOGY CO., LTD., Anhui (CN)

( * ) Notice: Subject to any disclaimer, the term of this patent is extended or adjusted under 35 U.S.C. 154(b) by 0 days.

(21) Appl. No.: 15/122,092

(22) PCT Filed: Jun. 26, 2015

(86) PCT No.: PCT/CN2015/082490
§ 371 (c)(1),
(2) Date: Aug. 26, 2016

(87) PCT Pub. No.: WO2016/095477
PCT Pub. Date: Jun. 23, 2016

(65) Prior Publication Data

US 2017/0069263 A1 Mar. 9, 2017

(30) Foreign Application Priority Data

Dec. 18, 2014 (CN) ..... 2014 1 0799222

(51) Int. Cl.
*G09G 3/3233* (2016.01)
*G09G 3/32* (2016.01)

(52) U.S. Cl.
CPC ..... *G09G 3/3233* (2013.01); *G09G 3/32* (2013.01); *G09G 2300/0819* (2013.01);
(Continued)

(58) Field of Classification Search
CPC ... G09G 2300/0866; G09G 2300/0861; G09G 2310/061; G09G 3/32; G09G 2320/0233;
(Continued)

(56) References Cited

U.S. PATENT DOCUMENTS 7,329,849 B2 12/2008 Kasai
7,570,236 B2 8/2009 Han et al.
(Continued)

FOREIGN PATENT DOCUMENTS

CN 1835058 A 9/2006
CN 1901008 A 1/2007
(Continued)

OTHER PUBLICATIONS

International Search Report and Written Opinion for International Application No. PCT/CN2015/082490, dated Sep. 25, 2015, 9 pages.
(Continued)

*Primary Examiner* — Abhishek Sarma
(74) *Attorney, Agent, or Firm* — Westman, Champlin & Koehler, P.A.

(57) ABSTRACT

The present disclosure provide a pixel driving circuit, a pixel driving method for the same, and a display apparatus. A voltage related to a threshold voltage of a driving unit is stored in a storage unit by a charge controlling unit at a compensating phase for the pixel driving circuit, such that the driving unit can be compensated by the storage unit at a driving phase for the pixel driving circuit. Thus, an influence of the threshold voltage of the driving unit on an operating current of the driving unit can be eliminated, and the
(Continued)

problem of uneven brightness of light emitting elements resulted from the threshold voltages being different can be solved, thereby improving a display quality of the display apparatus.

18 Claims, 5 Drawing Sheets

(52) U.S. Cl.
CPC ..... *G09G 2300/0842* (2013.01); *G09G 2310/061* (2013.01); *G09G 2320/0233* (2013.01); *G09G 2320/045* (2013.01)

(58) Field of Classification Search
CPC ..... G09G 2300/0842; G09G 2320/045; G09G 2300/0819; G09G 3/3233
See application file for complete search history.

(56) References Cited

U.S. PATENT DOCUMENTS

| | | | |
|---|---|---|---|
| 7,688,292 | B2 | 3/2010 | Park et al. |
| 8,674,914 | B2 | 3/2014 | Ohhashi |
| 8,749,454 | B2 | 6/2014 | Ono |
| 2010/0141644 | A1 | 6/2010 | Lee et al. |
| 2010/0149140 | A1 | 6/2010 | Nakamura et al. |
| 2010/0309187 | A1 | 12/2010 | Kang et al. |
| 2012/0120042 | A1* | 5/2012 | Tsai ..... G09G 3/3233 345/211 |
| 2013/0057532 | A1 | 3/2013 | Lee et al. |

FOREIGN PATENT DOCUMENTS

| | | | |
|---|---|---|---|
| CN | 100536631 | C | 9/2009 |
| CN | 101842829 | A | 9/2010 |
| CN | 102089798 | A | 6/2011 |
| CN | 102346999 | A | 2/2012 |
| CN | 102930821 | A | 2/2013 |
| CN | 103236238 | A | 8/2013 |
| CN | 203733448 | U | 7/2014 |
| CN | 104409047 | A | 3/2015 |
| CN | 204315211 | U | 5/2015 |
| JP | 2006-030728 | A | 2/2006 |
| JP | 2008-191684 | A | 8/2008 |
| KR | 2007-0057574 | A | 6/2007 |
| KR | 2013-0010936 | A | 1/2013 |

OTHER PUBLICATIONS

Communication from European Patent Application No. 15868989.3, dated Sep. 27, 2017, 14 pages.

* cited by examiner

PIXEL DRIVING CIRCUIT, A PIXEL DRIVING METHOD FOR THE SAME, AND A DISPLAY APPARATUS

CROSS-REFERENCE TO RELATED APPLICATION

This application is a Section 371 National Stage Application of International Application No. PCT/CN2015/082490, filed 26 Jun. 2015, which has not yet published, in Chinese, the contents of which are hereby incorporated by reference in their entirety.

TECHNICAL FIELD

The present disclosure relates to a field of display technology, and more particular, to a pixel driving circuit, a pixel driving method for the same, and a display apparatus, which can improve a display quality by compensating a threshold voltage of a driving unit for a light emitting element.

BACKGROUND

Active matrix organic light emitting diodes (AMOLED) display becomes one of hot spots in a field of panel displays. Compared with liquid crystal displays (LCD), organic light emitting diodes (OLED) panel has advantages, such as, a lower power consumption, a lower cost, be capable of self-luminous, a broader view, a faster response and the like. Currently, conventional LCD displays in the display field such as mobile phones, PDAs, digital cameras and the like, have been replaced by AMOLED displays. Pixel driving is a core of AMOLED display and is of great importance.

Differently from a thin film transistor-liquid crystal display (TFT-LCD) which controls brightness by a stable current, the AMOLED is driven by a current, and thus needs a stable current to control light emission. As shown in FIG. 1, a conventional AMOLED pixel driving circuit may use a 2T1C pixel driving circuit. The circuit only comprises one driving thin film transistor T1, one switch thin film transistor T2 and a storage capacitor C. When a scanning line select (i.e. scan) a row, a scanning signal Vscan is at a high level. Thus, T2 is turned on and a data signal Vdata is written into the storage capacitor C. When the scanning of the row is completed, Vscan is turned into a low level signal, and T2 is turned off. T1 is driven by a gate voltage stored on the storage capacitor C, and will generate a current to drive the AMOLED. Thus, the AMOLED can emit light during a displaying of a frame continuously. The current of the driving thin film transistor T1 in a saturated state can be represented by: $I_{oled}$=K(Vgs−Vth)^2, wherein K is a parameter related with the process and design of T1, Vgs is a gate-source voltage of the driving thin film transistor, and Vth is a threshold voltage of the driving thin film transistor. Once the size and process of the transistor is determined, the parameter K is determined. FIG. 2 is an operation timing diagram of the pixel driving circuit of FIG. 1, and shows a relationship in timing between the scanning signal provided by the scanning line and the data signal provided by the data line.

The light emission of the AMOLED is caused by the current generated when the driving thin film transistor (DTFT) is in a saturated state, irrespective of using a low temperature poly silicon (LTPS) process or a oxide process. Due to an unevenness of the process, threshold voltage difference at different locations of the driving thin film transistor may be generated, which will influence the consistency of the current driving device greatly. When inputting a same driving voltage, different threshold voltages will generate different driving currents, thereby leading to an inconsistency of the current passing through the OLED. This will further cause an unevenness brightness of the display, thereby affecting the displaying of a whole image.

Thus, there is a need for a method which can improve a consistency for driving currents of driving transistors so as to improve the display quality.

SUMMARY

The present disclosure relates to a pixel driving circuit, a pixel driving method for the same, and a display apparatus, which can improve a display quality by compensating a threshold voltage of a driving unit for a light emitting element. The compensation can be implemented, irrespective of the threshold voltage of a driving unit being positive or negative.

According to an aspect of the present disclosure, a pixel driving circuit is provided for driving a light emitting element. The pixel driving circuit may comprise: a scanning line Scan, configured to provide a scanning signal Vscan; a power line, comprising a first power line ELVss and a second power line ELVdd, and configured to supply a power to the pixel driving circuit; and a data line, configured to provide a data signal Vdata; a reference signal line Ref, configured to provide a reference signal Vref; a first controlling signal line S1, configured to providing a first controlling signal $V_{s1}$; a second controlling signal line S2, configured to providing a second controlling signal $V_{s2}$; a third controlling signal line S3, configured to providing a third controlling signal $V_{s3}$; a resetting signal lineInt, configured to provide a resetting signal Vint; a driving unit 310, having an input terminal connected to an output terminal of a light emission controlling unit, a control terminal connected to a first intermediate node N1, an output terminal connected to a second intermediate node N2, wherein the light emitting element is connected between the second intermediate node and the first power line ELVss; the light emission controlling unit 330, having an input terminal connected to the second power line ELVdd, a control terminal connected to the first controlling signal line S1, and the output terminal connected to the input terminal of the driving unit; a compensating unit 340, having an input terminal connected to the first intermediate node N1, a control terminal connected to the second controlling signal line S2, and an output terminal connected to a third intermediate node N3; a storage unit 350, having a first terminal connected to the third intermediate node N3 and a second terminal connected to the second intermediate node N2; a charge controlling unit 320, having a first input terminal connected to the reference signal line Ref, a second input terminal connected to the data line Data, a control terminal connected to the scanning line Scan, a first output terminal connected to the first intermediate node N1 and a second output terminal connected to the third intermediate node N3; a resetting unit 360, having an input terminal connected to the resetting signal lineInt, a control terminal connected to the third controlling signal line S3, and an output terminal connected to the second intermediate node N2; wherein at an initializing phase for the pixel driving circuit, under the control of the scanning signal and the third controlling signal, the charge controlling unit is configured to connect the reference signal line Ref with the first intermediate node N1 and to connect the data line Data with the third intermediate node N3, and the resetting unit is configured to connect the resetting signalInt with the second intermediate node N2, so as to charge the storage unit via the data signal and the resetting signal and to turn on the driving unit; at a compensating phase for the pixel driving circuit, under the control of the scanning signal and the first controlling signal, the charge controlling unit is configured to connect the reference signal line Ref with the first intermediate node N1 and to connect the data line Data with the third intermediate node N3, so as to keep the driving unit being turned on, and the driving unit is configured to charge the second intermediate node N2 until the driving unit 310 is turned off; at a driving phase for the pixel driving circuit, under the first controlling signal and the second controlling signal, the compensating unit is configured to connect the first intermediate node N1 and the third intermediate node N3, so as to turn on the driving unit, such that the driving unit provides a driving current being independent of a threshold voltage of the driving unit 310 to the light emitting element.

In one implementation, the driving unit 310 may comprise a driving transistor T1, which has a gate connected to the first intermediate node N1, a first electrode connected to the output terminal of the light emission controlling unit, and a second electrode connected to the second intermediate node N2, wherein the first electrode is one of a source and a drain, and the second electrode is the other of the source and the drain.

In one implementation, the light emission unit 330 may comprise a third transistor T3, which has a gate connected to the first controlling signal line S1, a first electrode connected to the second power line ELVdd, and a second electrode connected to the input terminal of the driving unit, wherein the first electrode is one of a source and a drain, and the second electrode is the other of the source and the drain.

In one implementation, the compensating unit 340 may comprise a fourth transistor T4, which has a gate connected to the second controlling signal line S2, a first electrode connected to the first intermediate node N1 and a second electrode connected to the third intermediate node N3, wherein the first electrode is one of a source and a drain, and the second electrode is the other of the source and the drain.

In one implementation, the storage unit may comprise a storage capacitor.

In one implementation, the charge controlling unit 320 may comprise a second transistor and a fifth transistor, wherein the second transistor has a gate connected to the scanning line Scan, a first electrode connected to the reference signal line Ref and a second electrode connected to the first intermediate node N1; and the fifth transistor has a gate connected to the scanning line Scan, a first electrode connected to the data line Data and a second electrode connected to the third intermediate node N3, wherein the first electrode is one of a source and a drain, and the second electrode is the other of the source and the drain.

In one implementation, the resetting unit 360 may comprise a sixth transistor T6, which has a gate connected to the third controlling signal line S3, a first electrode connected to the resetting signal lineInt and a second electrode connected to the second intermediate node N2, wherein the first electrode is one of a source and a drain, and the second electrode is the other of the source and the drain.

In one implementation, each of the driving transistor, the first transistor, the second transistor, the third transistor, the fourth transistor, the fifth transistor and the sixth transistor may be a P-type thin film transistor or a N-type thin film transistor.

According to a second aspect of the present disclosure, a pixel driving method which is applicable to the pixel driving circuit discussed above is provided. The pixel driving method may comprise: providing the scanning signal through the scanning line, providing the data signal through the data line, and providing the third controlling signal through the third controlling signal line, so as to enable the pixel driving circuit to enter the initializing phase; providing the scanning signal through the scanning line, providing the data signal through the data line, and providing the first controlling signal through the first controlling signal line, so as to enable the pixel driving circuit to enter the compensating phase; and providing the first controlling signal through the first controlling signal line and providing the second controlling signal through the second controlling signal line, so as to enable the pixel driving circuit to enter the driving phase.

According to a third aspect of the present disclosure, a display apparatus comprising the pixel driving circuit discussed above is provided.

BRIEF DESCRIPTION OF THE DRAWINGS

The above and other objectives, features and advantages will be obvious by illustrating the preferred embodiments of the present disclosure with reference to the drawing, in which.

DETAILED DESCRIPTION

In the following, embodiments of the present disclosure will be described in detail with reference to the drawings. Hereinafter, the specific embodiments are only intended to illustrate the disclosure, which should be construed as examples of the disclosure, rather than to limit it. Functions or elements known in the related art are not described in detail when they would obscure the disclosure with unnecessary detail.

Figure 1:
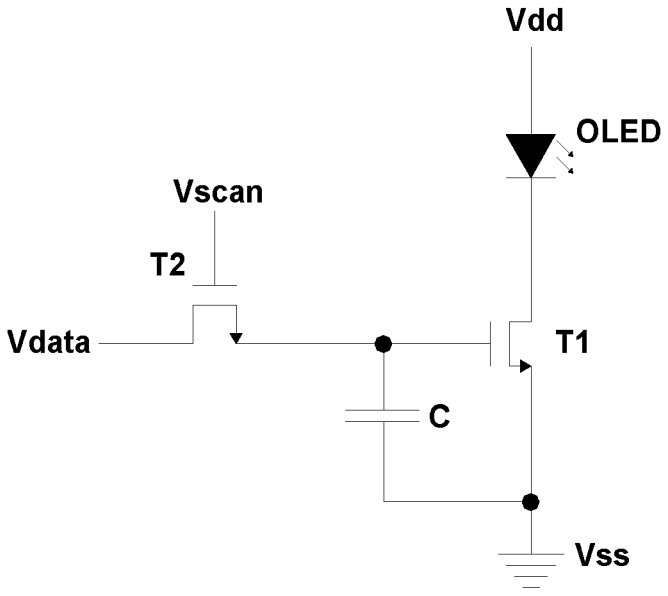
FIG. 1 is a structural diagram of a pixel driving circuit in the prior art.
Figure 2:
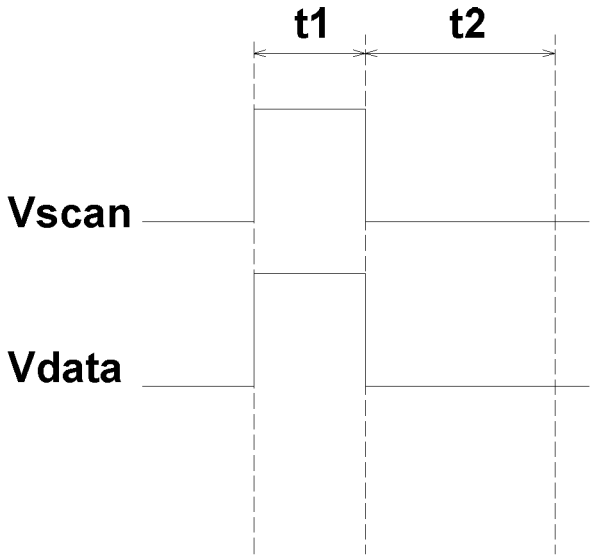
FIG. 2 is an operation timing diagram of the pixel driving circuit in the prior art.
Figure 3:
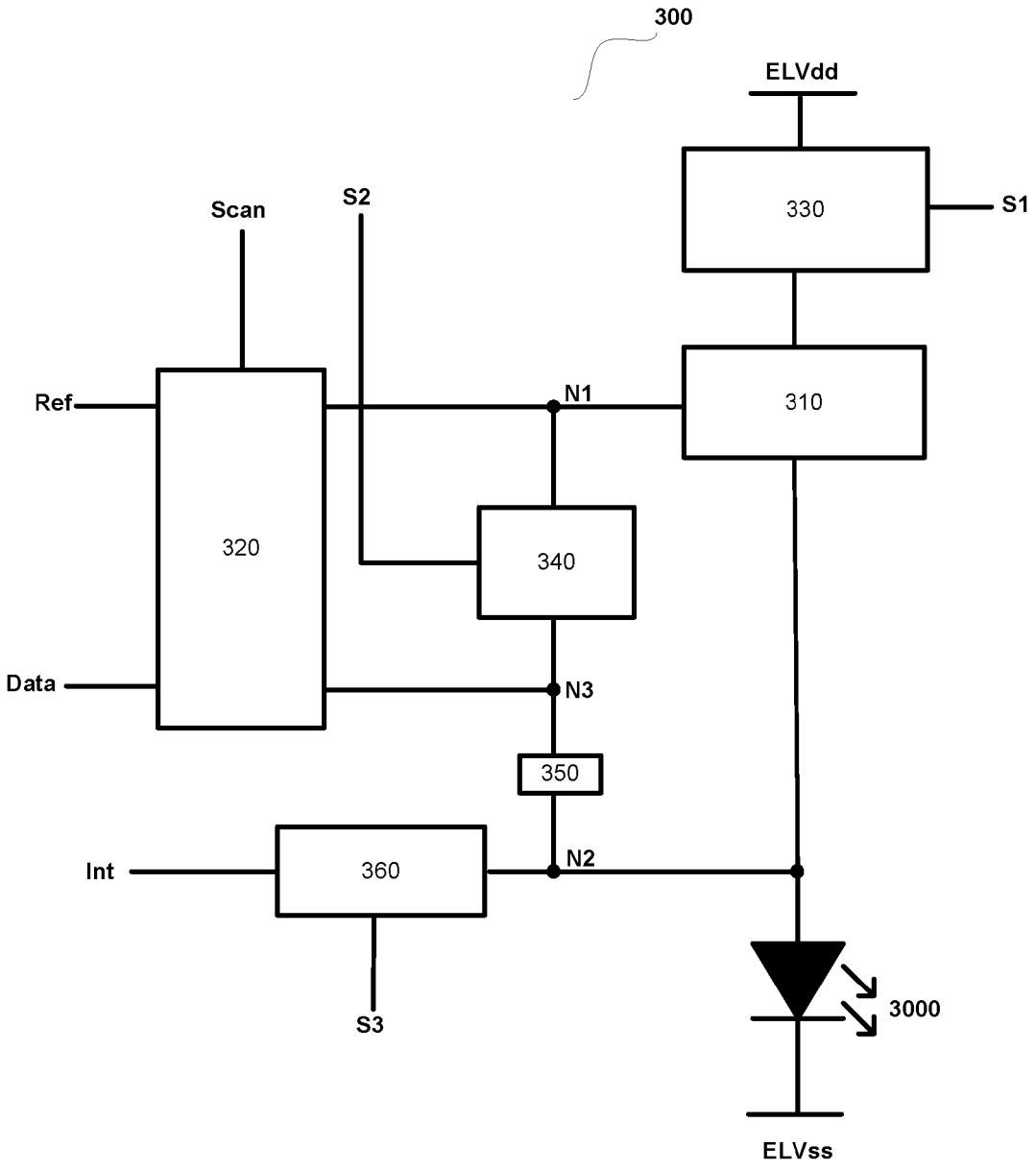
FIG. 3 is a structural diagram of a pixel driving circuit in a display apparatus according to an embodiment of the present disclosure.

FIG. 3 is a structural diagram of a pixel driving circuit 300 in a display apparatus according to an embodiment of the present disclosure. The pixel driving circuit 300 is used for driving a light emitting element 3000. In FIG. 3, the light emitting element 3000 is implemented with a light emitting diode (OLED). As shown in FIG. 3, the pixel driving circuit 300 according to the embodiments of the present disclosure may comprise a scanning line Scan, configured to provide a scanning signal Vscan; a power line comprising a first power line ELVss and a second power line ELVdd, and configured to supply a power to the pixel driving circuit 300; and a data line configured to provide a data signal Vdata.

In FIG. 3, the pixel driving circuit 300 may further comprise: a reference signal line Ref, configured to provide a reference signal Vref; a first controlling signal line S1, configured to providing a first controlling signal $V_{s1}$; a second controlling signal line S2, configured to providing a second controlling signal $V_{s2}$; a third controlling signal line S3, configured to providing a third controlling signal $V_{s3}$; a resetting signal lineInt, configured to provide a resetting signal Vint.

In FIG. 3, the pixel driving circuit 300 may further comprise a driving unit 310, having an input terminal connected to an output terminal of a light emission controlling unit, a control terminal connected to a first intermediate node N1, an output terminal connected to a second intermediate node N2, wherein the light emitting element 3000 is connected between the second intermediate node N2 and the first power line ELVss; the light emission controlling unit 330, having an input terminal connected to the second power line ELVdd, a control terminal connected to the first controlling signal line S1, and the output terminal connected to the input terminal of the driving unit; a compensating unit 340, having an input terminal connected to the first intermediate node N1, a control terminal connected to the second controlling signal line S2, and an output terminal connected to a third intermediate node N3; a storage unit 350, having a first terminal connected to the third intermediate node N3 and a second terminal connected to the second intermediate node N2; a charge controlling unit 320, having a first input terminal connected to the reference signal line Ref, a second input terminal connected to the data line Data, a control terminal connected to the scanning line Scan, a first output terminal connected to the first intermediate node N1 and a second output terminal connected to the third intermediate node N3; a resetting unit 360, having an input terminal connected to the resetting signal lineInt, a control terminal connected to the third controlling signal line S3, and an output terminal connected to the second intermediate node N2.

At an initializing phase for the pixel driving circuit 300, under the control of the scanning signal and the third controlling signal, the charge controlling unit 320 is configured to connect the reference signal line Ref with the first intermediate node N1 and to connect the data line Data with the third intermediate node N3, and the resetting unit 360 is configured to connect the resetting signalInt with the second intermediate node N2, so as to charge the storage unit 350 via the data signal and the resetting signal and to turn on the driving unit 310.

At a compensating phase for the pixel driving circuit 300, under the control of the scanning signal and the first controlling signal, the charge controlling unit 320 is configured to connect the reference signal line Ref with the first intermediate node N1 and to connect the data line Data with the third intermediate node N3, so as to keep the driving unit 310 be turned on, and the driving unit 310 is configured to charge the second intermediate node N2 until the driving unit 310 is turned off.

At a driving phase for the pixel driving circuit 300, under the first controlling signal and the second controlling signal, the compensating unit 340 is configured to connect the first intermediate node N1 and the third intermediate node N3, so as to turn on the driving unit 310, such that the driving unit 310 provides a driving current being independent of a threshold voltage of the driving unit 310 to the light emitting element 3000.

Figure 4:
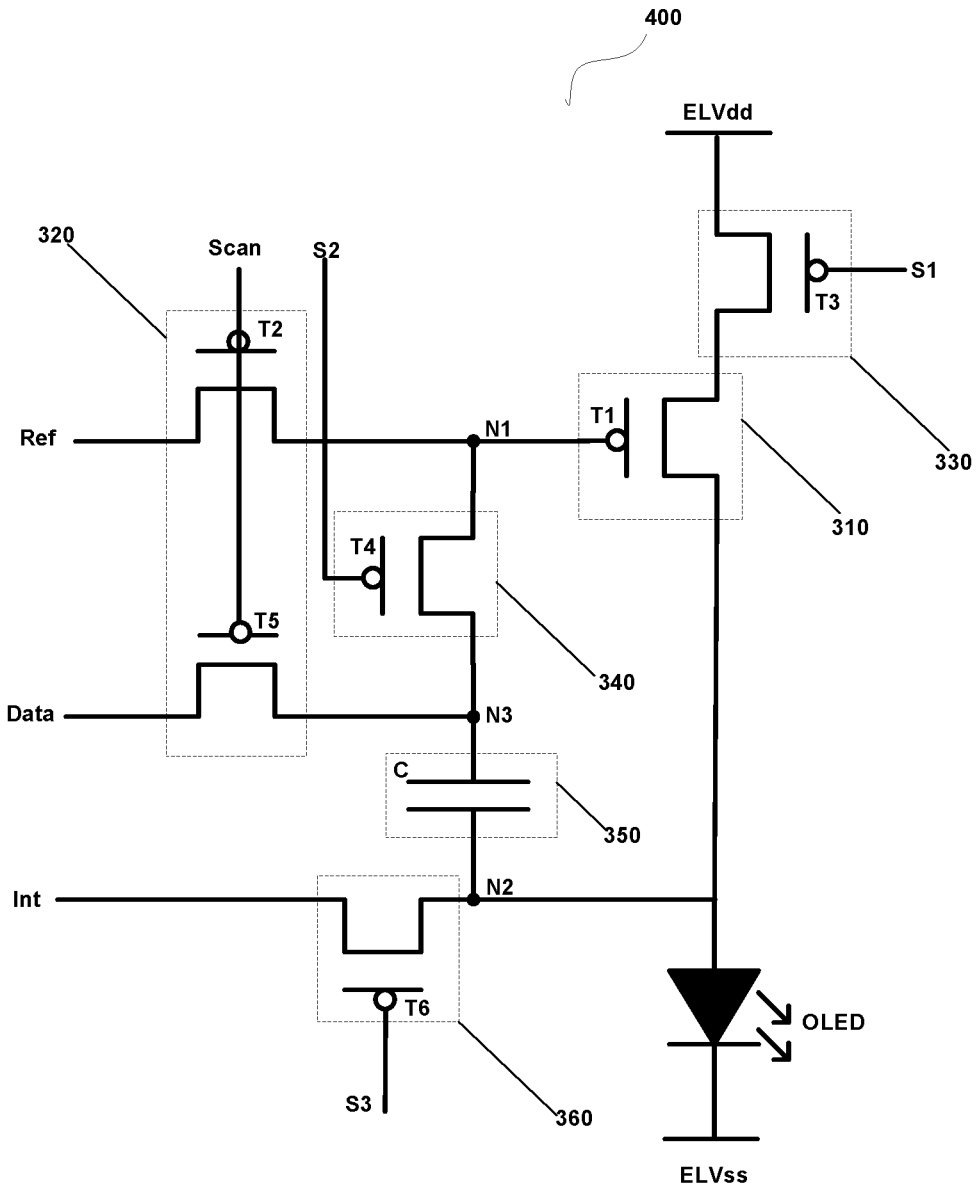
FIG. 4 is a structural diagram of the pixel driving circuit in the display apparatus according to another embodiment of the present disclosure.

FIG. 4 is a structural diagram of the pixel driving circuit in the display apparatus according to another embodiment of the present disclosure.

As shown in FIG. 4, the pixel driving circuit 400 according to the embodiments of the present disclosure may comprise: a scanning line Scan, configured to provide a scanning signal Vscan; a power line, comprising a first power line ELVss and a second power line ELVdd, and configured to supply a power to the pixel driving circuit 300; and a data line, configured to provide a data signal Vdata; a reference signal line Ref, configured to provide a reference signal Vref; a first controlling signal line S1, configured to providing a first controlling signal $V_{s1}$; a second controlling signal line S2, configured to providing a second controlling signal $V_{s2}$; a third controlling signal line S3, configured to providing a third controlling signal $V_{s3}$; a resetting signal lineInt, configured to provide a resetting signal Vint.

Similarly with the pixel driving circuit 300 shown in FIG. 3, the pixel driving circuit 400 according to the embodiments of the present disclosure may comprise a driving unit 310, a charge controlling unit 320, a light emission controlling unit 330, a compensating unit 340, a storage unit 350 and a resetting unit 360.

As shown in FIG. 4, in the pixel driving circuit 400 according to the embodiments of the disclosure, the driving unit 310 may comprise a driving transistor T1, which has a gate connected to the first intermediate node N1, a drain connected to the output terminal of the light emission controlling unit, and a source connected to the second intermediate node N2. In one embodiment, the drain of the driving transistor T1 may correspond to the input terminal of the driving unit, the gate of the driving transistor T1 may correspond to the control terminal of the driving unit, and the source of the driving transistor T1 may correspond to the output terminal of the driving unit.

As shown in FIG. 4, in the pixel driving circuit 400 according to the embodiments of the disclosure, the light emission unit 330 may comprise a third transistor T3, which has a gate connected to the first controlling signal line S1, a drain connected to the second power line ELVdd, and a source connected to the input terminal of the driving unit 310. In the embodiment, the drain of the third transistor T3 may correspond to the input terminal of the light emission controlling unit 330, the gate of the third transistor T3 may correspond to the control terminal of the light emission controlling unit 330, and the source of the third transistor T3 may correspond to the output terminal of the light emission controlling unit 330.

As shown in FIG. 4, in the pixel driving circuit 400 according to the embodiments of the disclosure, the compensating unit 340 may comprise a fourth transistor T4, which has a gate connected to the second controlling signal line S2, a drain connected to the first intermediate node N1 and a source connected to the third intermediate node N3. In the embodiment, the drain of the fourth transistor T4 may correspond to the input terminal of the compensating unit 340, the gate of the fourth transistor T4 may correspond to the control terminal of the compensating unit 340, and the source of the fourth transistor T4 may correspond to the output terminal of the compensating unit 340.

As shown in FIG. 4, in the pixel driving circuit 400 according to the embodiments of the disclosure, the storage unit 350 may comprise a storage capacitor C. The storage capacitor C may be connected between the second intermediate node N2 and the third intermediate node N3.

As shown in FIG. 4, in the pixel driving circuit 400 according to the embodiments of the disclosure, the charge controlling unit 320 may comprise a second transistor T2 and a fifth transistor T5, wherein the second transistor T2 has a gate connected to the scanning line Scan, a drain connected to the reference signal line Ref and a source connected to the first intermediate node N1; and the fifth transistor T5 has a gate connected to the scanning line Scan, a drain connected to the data line Data and a source connected to the third intermediate node N3. In the embodiment, the gates of the second transistor T2 and the fifth transistor T5 may correspond to a control terminal of the charge controlling unit 320, the drain may correspond to the first input terminal of the charge controlling unit 320, and its source may correspond to the first output terminal of the charge controlling unit; the drain of the fifth transistor T5 may correspond to the second input terminal of the charge controlling unit 320, and its source may correspond to the second output terminal of the charge controlling unit 320.

As shown in FIG. 4, in the pixel driving circuit 400 according to the embodiments of the disclosure, the resetting unit 360 may comprise a sixth transistor T6, which has a drain connected to the resetting signal lineInt, a gate connected to the third controlling signal line S3 and a source connected to the second intermediate node N2. In the embodiment, the drain of the sixth transistor T6 may correspond to the input terminal of the resetting unit 360, the gate may correspond to the control terminal of the resetting unit 360, and a source may correspond to the output terminal of the resetting unit 360.

Each of the driving transistor T1, the second transistor T2, the third transistor T3, the fourth transistor T4, the fifth transistor T5 and the sixth transistor T6 shown in FIG. 4 may be a N-type thin film transistor or a P-type thin film transistor. According to the different types of the used transistors, the source and the drain of each of the driving transistor T1, the second transistor T2, the third transistor T3, the fourth transistor T4, the fifth transistor T5 and the sixth transistor T6 may be interchangeable.

Figure 5:
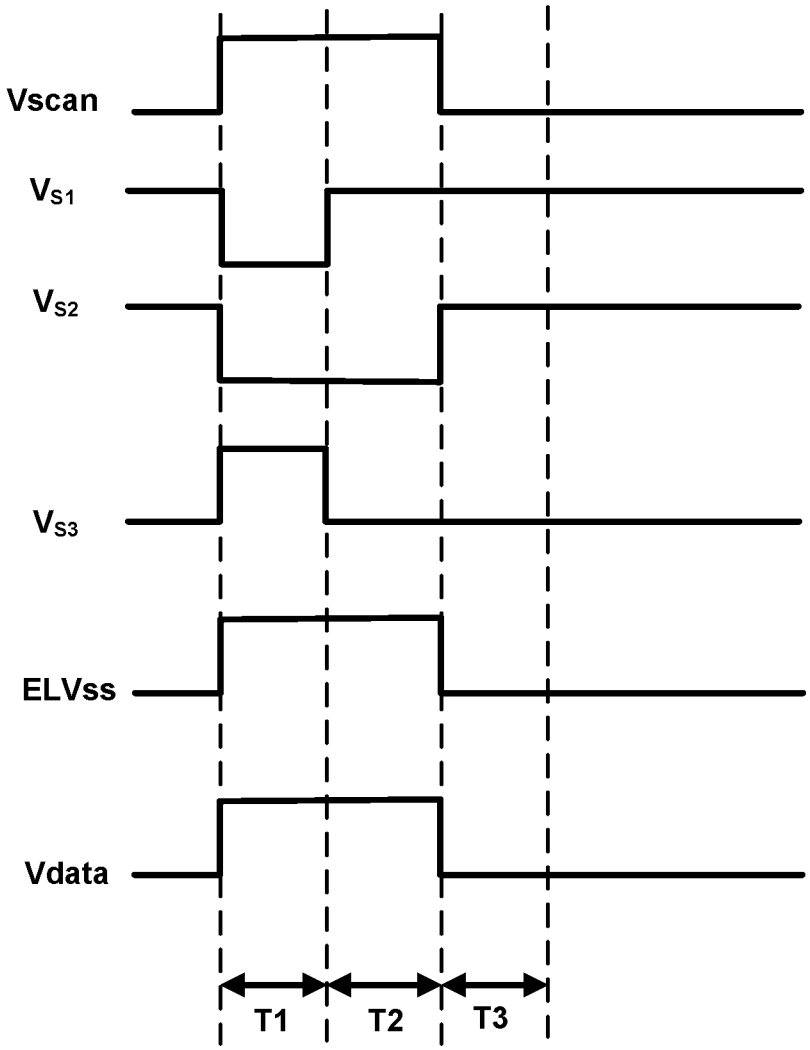
FIG. 5 is an operation timing diagram of the pixel driving circuit in the display apparatus according to another embodiment of the present disclosure.

FIG. 5 is an operation timing diagram of the pixel driving circuit 400 according to the embodiment of the present disclosure. As shown in FIG. 5, the pixel driving circuit 400 may comprise three phases, i.e. a first phase (a initializing phase); a second phase (a compensating phase); and a third phase (a driving phase). For an easy understanding, in the embodiment, it is assumed that each transistor is a N-type transistor, which is turned on at a high level and turned off at a low level. A high level of a power supply is shown as ELVdd, and a low level of the power supply is shown as ELVss. In a level design, the following condition should be satisfied: Vref>Vint+|Vth|, i.e. the high level of ELVss should be higher than Vref+|Vth|, wherein Vth is a threshold voltage for driving transistor T1. Those skilled in the art will understand that the disclosure is not limited to this.

At the first phase T1, it is an initializing phase. At this phase, the scanning signal Vscan provided by the scanning line Scan is at a high level, and the third controlling signal $V_{S3}$ provided by the third controlling signal line S3 is also at a high level. ELVss is at a high level. Thus, transistors T2, T5 and T6 are turned on. Since the signals $V_{S2}$, $V_{S2}$ provided by the first controlling signal line S1 and the second controlling signal line S2 are at a low level, the transistors T3 and T4 are turned off. At this time, the level of the reference signal provided by the reference signal line Ref is written into the gate of the driving transistor T1, and the data voltage is written into one end of the storage capacitor C, i.e. V_N1=Vdata, and the resetting signal is written into the other end of the storage capacitor C, i.e. V_N2=Vint. In other words, the voltage at the source of the driving transistor T1 is Vint. Thus, a difference between the voltage at the gate and the voltage at the drain of the driving transistor T1 is Vref−Vint>Vth, and the driving transistor T1 is accordingly turned on. Since the signal ELVss is at a high level at this time, and the high level of ELVss is higher than Vint as described above, OLED is at inverting connection, and will emit no light.

At the second phase T2, it is a compensating phase. At this phase, the scanning signal Vscan provided by the scanning line Scan is at a high level, and the first controlling signal $V_{S1}$ provided by the first controlling signal line S1 is also at a high level. ELVss is at a high level. The transistors T2 and T5 are still turned on. Thus, the Vref is still written into the gate of the driving transistor T1, and the one end of the storage capacitor is maintained at the data voltage, i.e. V_N1=Vdata. Since the first controlling signal $V_{S1}$ is at a high level, the transistor T3 is turned on. Meanwhile the transistor T6 is turned off, since the third controlling signal $V_{S3}$ is at a low level. In view of above, the driving transistor T1 is turned on at this time, and it will charge the second intermediate node N2 until the voltage V_N2 at N2 is equal to Vref−Vth, i.e. V_N2=Vref−Vth. The voltage cross two ends of the storage capacitor C is V_N1N2=Vdata−(Vref−Vth)=Vdata−Vref+Vth. Since the ELVss is at a high level at this time, and the high level of ELVss is higher than Vref−Vth as described above, OLED is at inverting connection, and will emit no light. According to the above description, it is known that the driving transistor T1 is turned on to store the threshold voltage at this phase, irrespective of the threshold voltage of the driving transistor T1 being positive or negative.

At the third phase T3, it is a driving phase. At this phase, the first controlling signal $V_{S1}$ provided by the first controlling signal line S1 and the second controlling signal $V_{S2}$ provided by the second controlling signal line S2 are both at a high level. ELVss is at a low level. The transistors T3 and T4 are turned on. Since the scanning signal Vscan and the third controlling signal $V_{S3}$ are both at a low level, the transistors T2, T5 and T6 are turned off. At this time, the difference between the voltage at the gate and the voltage at the drain of the driving transistor T1 is kept as a value at an end of the second phase T2, i.e. Vgs=V_N1N2=Vdata−Vref+Vth. Furthermore, since a value obtained by subtracting the threshold voltage Vth from the gate-source voltage Vgs of the driving transistor T1 is smaller than or equal to the drain-source voltage Vds of the driving transistor T1, i.e. Vgs−Vth≤Vds, the driving transistor T1 is in a saturated turning on state, wherein the current provided to the light emitting element OLED depends on the gate-source voltage Vgs of the driving transistor. In particular, I=K(Vgs−Vth)^2=K(Vdata−Vref+Vth−Vth)^2=K(Vdata−Vref)^2, wherein K is a constant related to process parameters and physical dimensions of the driving transistor T1.

It is seen that the light emission current for driving the OLED only relates to the reference voltage Vref and the data voltage Vdata, and is independent of the threshold voltage Vth for the driving transistor.

At the subsequent phases, each controlling signal is the same as the controlling signal at the phase T3. Accordingly, OLED keeps in emitting light until a high level scanning signal is received again.

Although specific structures of the driving unit, the charge controlling unit, the light emission controlling unit, a compensating unit, a storage unit and a resetting unit are illustrated in FIG. 4, those skilled in the art will understand that these units may have other structures. FIG. 4 only shows one example of the present disclosure.

Figure 6:
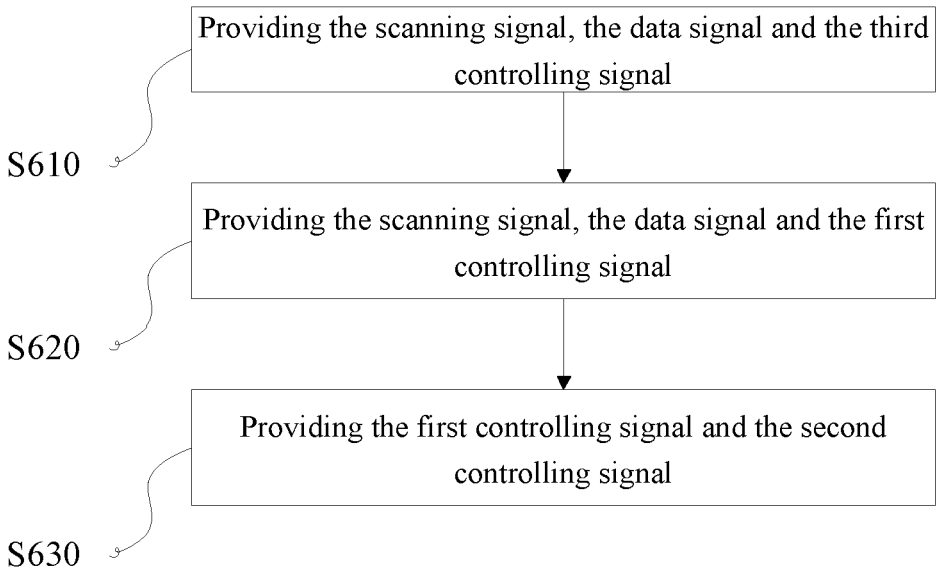
FIG. 6 is a flow chart for the pixel driving method according to the embodiment of the disclosure.

FIG. 6 is a flow chart for the pixel driving method according to the embodiment of the disclosure. The pixel driving method is applicable to the pixel driving circuit according to the embodiments of the present disclosure. As shown in FIG. 6, the driving method may comprise: firstly, in S610, providing the scanning signal through the scanning line, providing the data signal through the data line, and providing the third controlling signal through the third controlling signal line, so as to enable the pixel driving circuit to enter the initializing phase; then, in S620, providing the scanning signal through the scanning line, providing the data signal through the data line, and providing the first controlling signal through the first controlling signal line, so as to enable the pixel driving circuit to enter the compensating phase; and in S630, providing the first controlling signal through the first controlling signal line and providing the second controlling signal through the second controlling signal line, so as to enable the pixel driving circuit to enter the driving phase. In order to ensure that the OLED does not emit light at the initializing phase and the compensating phase for the pixel driving circuit, the supply voltage of the first power line is at a high level during the initializing phase and the compensating phase. The supply voltage of the first power line is higher than a sum of a voltage of the reference signal and a threshold voltage of the driving unit, wherein the voltage of the reference signal is higher than a sum of a voltage of the resetting signal and the threshold voltage of the driving unit.

In particular, with reference to the pixel driving circuit shown in FIG. 4, by applying the operation timing diagram shown in FIG. 5, at the initializing phase for the pixel driving circuit, the charge controlling unit, the resetting unit and the driving unit are turned on, and the light emission controlling unit and the compensating unit is turned off. In other words, the driving transistor, the second transistor, the fifth transistor and the sixth transistor are turned on, and the third transistor and the fourth transistor are turned off. At the compensating phase for the pixel driving circuit, the charge controlling unit, the light emission controlling unit and the driving unit are turned on, and the resetting unit and the compensating unit is turned off. In other words, the driving transistor, the second transistor, the third transistor and the fifth transistor are turned on, and the fourth transistor and the sixth transistor are turned off. At the driving phase for the pixel driving circuit, the driving unit, the light emission controlling unit and the compensating unit are turned on, and the charge controlling unit and the resetting unit is turned off. In other words, the driving transistor, the third transistor and the fourth transistor are turned on, and the second transistor, the fifth transistor and the sixth transistor are turned off.

The present disclosure may further provide a display apparatus comprising the above pixel driving circuit, the detailed description of which has been described in the above embodiments, and the same content will no longer be repeated.

It should be noted that the present disclosure is exemplarily illustrated in the above description, which is not intended to limit the disclosure to the above steps and structures. One or more steps and structures can be modified or omitted if it is necessary. Thus, some of the steps or units are not essential elements for implementing the inventive concept of the present disclosure. Thus, the essential features of this disclosure only limit to a minimum requirement for implementing the inventive concept of the present disclosure, and are not defined by the specific implementations discussed above.

The present disclosure has been illustrated in combination with the preferred embodiments. It is understood that those skilled in the art can make various modifications and variations to the present disclosure without departing from the spirit and scope of the present disclosure. Thus, the scope of the present disclosure is not limited to the above embodiments, and it is defined by the attached claims.

I claim:

1. A pixel driving circuit for driving a light emitting element, comprising:

a scanning line, configured to provide a scanning signal; a power line comprising a first power line and a second power line, and configured to supply a power to the pixel driving circuit;

and a data line configured to provide a data signal;

a reference signal line, configured to provide a reference signal;

a first controlling signal line, configured to providing a first controlling signal;

a second controlling signal line, configured to providing a second controlling signal;

a third controlling signal line, configured to providing a third controlling signal;

a resetting signal line, configured to provide a resetting signal;

a driving unit, having an input terminal connected to an output terminal of a light emission controlling unit, a control terminal connected to a first intermediate node, an output terminal connected to a second intermediate node, wherein the light emitting element is connected between the second intermediate node and the first power line;

the light emission controlling unit, having an input terminal connected to the second power line, a control terminal connected to the first controlling signal line, and an output terminal connected to the input terminal of the driving unit;

a compensating unit, having an input terminal connected to the first intermediate node, a control terminal connected to the second controlling signal line, and an output terminal connected to a third intermediate node;

a storage unit, having a first terminal connected to the third intermediate node and a second terminal connected to the second intermediate node;

a charge controlling unit, having a first input terminal connected to the reference signal line, a second input terminal connected to the data line, a control terminal connected to the scanning line, a first output terminal connected to the first intermediate node and a second output terminal connected to the third intermediate node;

a resetting unit, having an input terminal connected to the resetting signal line, a control terminal connected to the third controlling signal line, and an output terminal connected to the second intermediate node;

wherein at an initializing phase for the pixel driving circuit, under the control of the scanning signal and the third controlling signal, the charge controlling unit is configured to connect the reference signal line with the first intermediate node and to connect the data line with the third intermediate node, and the resetting unit is configured to connect the resetting signal with the second intermediate node, so as to charge the storage unit via the data signal and the resetting signal and to turn on the driving unit;

at a compensating phase for the pixel driving circuit, under the control of the scanning signal and the first controlling signal, the charge controlling unit is configured to connect the reference signal line with the first intermediate node and to connect the data line with the third intermediate node, so as to keep the driving unit being turned on, and the driving unit is configured to charge the second intermediate node until the driving unit is turned off; and at a driving phase for the pixel driving circuit, under the first controlling signal and the second controlling signal, the compensating unit is configured to connect the first intermediate node and the third intermediate node (N3), so as to turn on the driving unit, such that the driving unit provides a driving current being independent of a threshold voltage of the driving unit to the light emitting element.

2. The pixel driving circuit of claim 1, wherein the driving unit comprises a driving transistor, which has a gate connected to the first intermediate node, a first electrode connected to the output terminal of the light emission controlling unit, and a second electrode connected to the second intermediate node, wherein the first electrode is one of a source and a drain, and the second electrode is the other of the source and the drain.

3. The pixel driving circuit of claim 1, wherein the light emission unit comprises a third transistor, which has a gate connected to the first controlling signal line, a first electrode connected to the second power line, and a second electrode connected to the input terminal of the driving unit, wherein the first electrode is one of a source and a drain, and the second electrode is the other of the source and the drain.

4. The pixel driving circuit of claim 1, wherein the compensating unit comprises a fourth transistor which has a gate connected to the second controlling signal line, a first electrode connected to the first intermediate node and a second electrode connected to the third intermediate node, wherein the first electrode is one of a source and a drain, and the second electrode is the other of the source and the drain.

5. The pixel driving circuit of claim 1, wherein the storage unit comprises a storage capacitor.

6. The pixel driving circuit of claim 1, wherein the charge controlling unit comprises a second transistor and a fifth transistor, wherein the second transistor has a gate connected to the scanning line, a first electrode connected to the reference signal line and a second electrode connected to the first intermediate node; and the fifth transistor has a gate connected to the scanning line, a first electrode connected to the data line and a second electrode connected to the third intermediate node, wherein the first electrode is one of a source and a drain, and the second electrode is the other of the source and the drain.

7. The pixel driving circuit of claim 1, wherein the resetting unit comprises a sixth transistor, which has a gate connected to the third controlling signal line, a first electrode connected to the resetting signal line and a second electrode connected to the second intermediate node, wherein the first electrode is one of a source and a drain, and the second electrode is the other of the source and the drain.

8. The pixel driving circuit of claim 2, wherein the driving transistor is a P-type thin film transistor or a N-type thin film transistor.

9. The pixel driving circuit of claim 3, wherein the third transistor is a P-type thin film transistor or a N-type thin film transistor.

10. The pixel driving circuit of claim 4, wherein the fourth transistor is a P-type thin film transistor or a N-type thin film transistor.

11. The pixel driving circuit of claim 6, wherein the second transistor and the fifth transistor are both P-type thin film transistors or N-type thin film transistors.

12. The pixel driving circuit of claim 7, wherein the sixth transistor is a P-type thin film transistor or a N-type thin film transistor.

13. A pixel driving method for the pixel driving circuit of claim 1, comprising:

providing the scanning signal through the scanning line, providing the data signal through the data line, and providing the third controlling signal through the third controlling signal line, so as to enable the pixel driving circuit to enter the initializing phase;

providing the scanning signal through the scanning line, providing the data signal through the data line, and providing the first controlling signal through the first controlling signal line, so as to enable the pixel driving circuit to enter the compensating phase;

providing the first controlling signal through the first controlling signal line and providing the second controlling signal through the second controlling signal line, so as to enable the pixel driving circuit to enter the driving phase.

14. The pixel driving method of claim 13, wherein a supply voltage of the first power line is at a high level during the initializing phase and the compensating phase for the pixel driving circuit, and the supply voltage of the first power line is higher than a sum of a voltage of the reference signal and a threshold voltage of the driving unit, and the voltage of the reference signal is higher than a sum of a voltage of the resetting signal and the threshold voltage of the driving unit.

15. The pixel driving method of claim 13, wherein at the initializing phase for the pixel driving circuit, the charge controlling unit, the resetting unit and the driving unit are turned on, and the light emission controlling unit and the compensating unit are turned off.

16. The pixel driving method of claim 13, wherein at the compensating phase for the pixel driving circuit, the charge controlling unit, the light emission controlling unit and the driving unit are turned on, and the resetting unit and the compensating unit are turned on.

17. The pixel driving method of claim 13, wherein at the driving phase for the pixel driving circuit, the driving unit, the light emission controlling unit and the compensating unit are turned on, and the charge controlling unit and the resetting unit are turned off.

18. A display apparatus comprising the pixel driving circuit of claim 1.

* * * * *